United States Patent [19]

Meyer et al.

[11] 3,998,001

[45] Dec. 21, 1976

[54] DOLL SHOWER AND BUBBLE BATH DEVICE

[75] Inventors: Burton C. Meyer, Downers Grove; Donald F. Nix, Hanover Park; Derek A. Brand, Naperville, all of Ill.

[73] Assignee: Marvin Glass & Associates, Chicago, Ill.

[22] Filed: Feb. 5, 1976

[21] Appl. No.: 655,420

[52] U.S. Cl. ..... 46/8; 46/41; 46/116

[51] Int. Cl.[2] ..... A63H 3/52; A63H 33/28

[58] Field of Search ..... 46/7, 8, 14, 41, 91, 46/116

[56] References Cited

UNITED STATES PATENTS

| | | | |
|---|---|---|---|
| 2,133,499 | 10/1938 | Dolan | 46/8 |
| 2,533,534 | 12/1950 | Tellefsen | 46/14 |
| 2,814,905 | 12/1957 | Notaro | 46/14 |
| 2,832,293 | 4/1958 | Gotz | 46/14 |
| 3,015,828 | 1/1962 | Beebe | 46/14 |
| 3,842,531 | 10/1974 | Sloan | 46/116 |

*Primary Examiner*—Louis G. Mancene
*Assistant Examiner*—Robert F. Cutting
*Attorney, Agent, or Firm*—Coffee and Sweeney

[57] ABSTRACT

A toy bathtub device for simulation of giving a doll a shower or bubble bath, or the like. The device includes a base tub portion having an upstanding post supporting a showerhead which includes a spray nozzle. A shower curtain is mounted on the post for preventing undue splashing of water from the nozzle and tub. The nozzle is supplied with water through a conduit by a bellows-like pump which operates in combination with a check valve to pump water in a recycling fashion from a tub water reservoir through the conduit and thence from the nozzle. The tub is provided with a drain plug for draining water from the tub into the water reservoir for reuse. The floor of the tub also is provided with an aeration system in the form of a peripheral series of perforations or ports through the tub bottom wall which are interconnected by a manifold. The manifold is supplied with air under pressure from another bellows pump acting against a check valve. Each of the pumps is individually controllable by a separate manually operable pumping handle accessible from the exterior of the device so that a child, in play, can select activation of the shower and/or activation of the bubbling system or both simultaneously.

12 Claims, 8 Drawing Figures

26
28
30
24
30
32
2
34
24b
34a
22
36
104
20
2
70

26
28
24
44
24a
20a
3
3
92
88
35
36
22
88
70
90
38
52
54
90
44
4
4
54
48
50
56
46
58
62
60
100
96
98
94
68
75
76
64
66
20

Fig 5
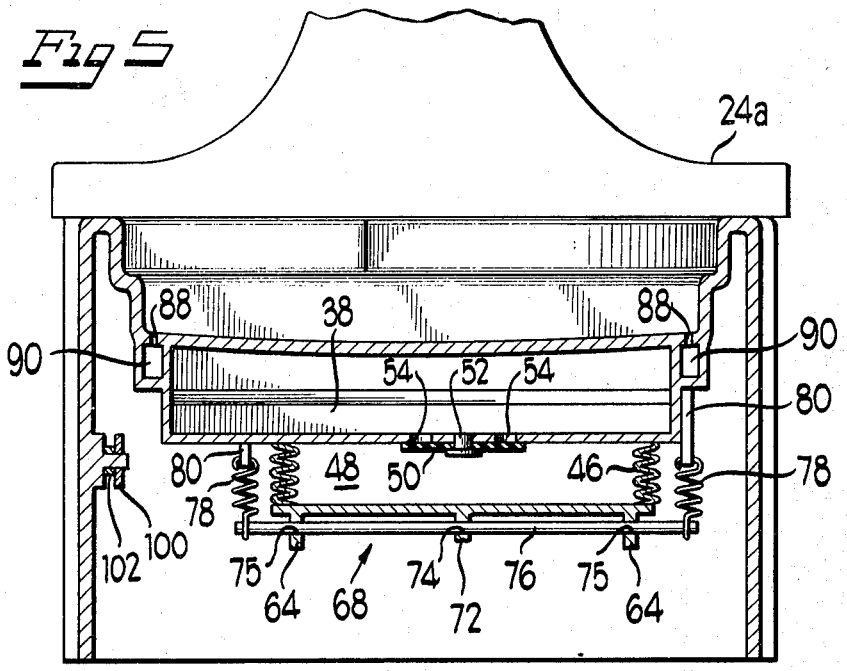
Fig 6
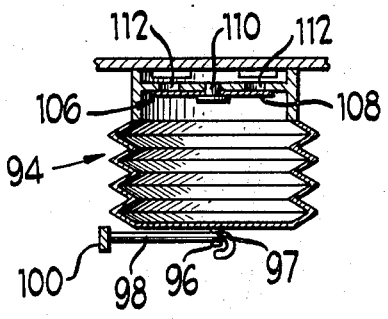
Fig 8
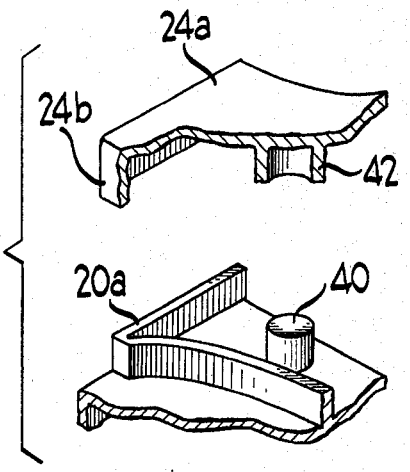
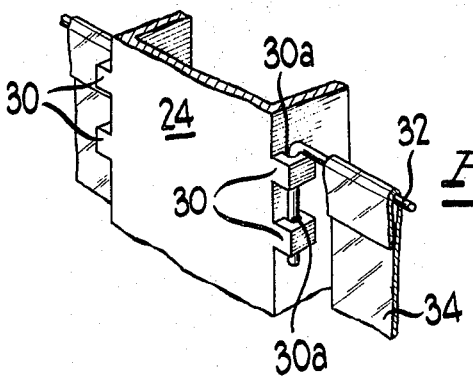
Fig 7

DOLL SHOWER AND BUBBLE BATH DEVICE

BACKGROUND OF THE INVENTION

1. Field of the Invention

This invention relates to dolls and accessories for use by a child in playing with dolls. More particularly, the invention relates to an amusement or diversion accessory in the form of a bathtub for a doll and in which the doll can be given both a shower and a bubble bath.

2. Brief Description of the Prior Art

Dolls and accessories for use in their play have long had acceptance by the public and particularly by children. Such accessories have, in the past, included camping sets for dolls, clothing sets for dolls, among many others. Also, there have been provided bathing sets for dolls, one in particular being described in Notaro U.S. Letters Pat. No. 2,814,905 issued December 3, 1957. The Notaro patent shows a system having a tub for receiving a doll and a bulb-like pump for pumping water from the tub through a shower nozzle for giving the doll a shower. As to other prior art, Tellefsen U.S. Leters Pat. No. 2,533,534 issued Dec. 12, 1950 shows a tub having a reservoir which, when compressed, forces water upwardly through a tub faucet. Still other devices are shown in U.S. Letters Pat. No. 2,831,293 issued Apr. 22, 1958 to G. Dots and U.S. Letters Pat. No. 3,015,828 issued Jan. 9,1962 to H. R. Bebe.

SUMMARY OF THE INVENTION

A new and useful device for the amusement of children in playing with figurine toys such as dolls. The device is in the form of a bathtub having an overhanging shower nozzle for directing a spray of liquid such as water into the tub. Additionally, an air supply system including a plurality of spaced ports in the tub is provided for delivery of air through the liquid in the tub to simulate a bubble bath effect. Both the delivery of the spray of water and the delivery of air are separately manually controllable so that either effect or both can be selected by the child during play.

The system for supplying water to the nozzle includes a pump, e.g., a bellows. The tub has a drain port with a removable plug and the water supply pump conveniently can receive water drained from the tub and be recirculated through the nozzle.

The air delivery system includes a manifold for receiving air from an air pump, e.g., a bellows, and distributes the air to the air ports.

While this invention is susceptible of embodiment in many different forms, here is shown in the drawings and will herein be described in detail a specific embodiment and modification thereof, with the understanding that the present disclosure is to be considered as an exemplification of the principles of the invention and is not intended to limit the invention to the embodiment illustrated.

BRIEF DESCRIPTION OF THE DRAWINGS

FIG. 5 is a sectional view taken generally along the line 5—5 of FIG. 4;

FIG. 6 is a vertical section through a bellows-type air pump forming a portion of the device, taken generally along line 6—6 of FIG. 4;

FIG. 7 is an enlarged fragmentary perspective view of a portion of a shower curtain hanging system used in the device of FIG. 1; and FIG. 8 is an exploded fragmentary perspective view of a mounting used for removably supporting an upstanding post portion from a base portion in the device of FIG. 1.

DESCRIPTION OF THE PREFERRED EMBODIMENT

Figures 1, 2:
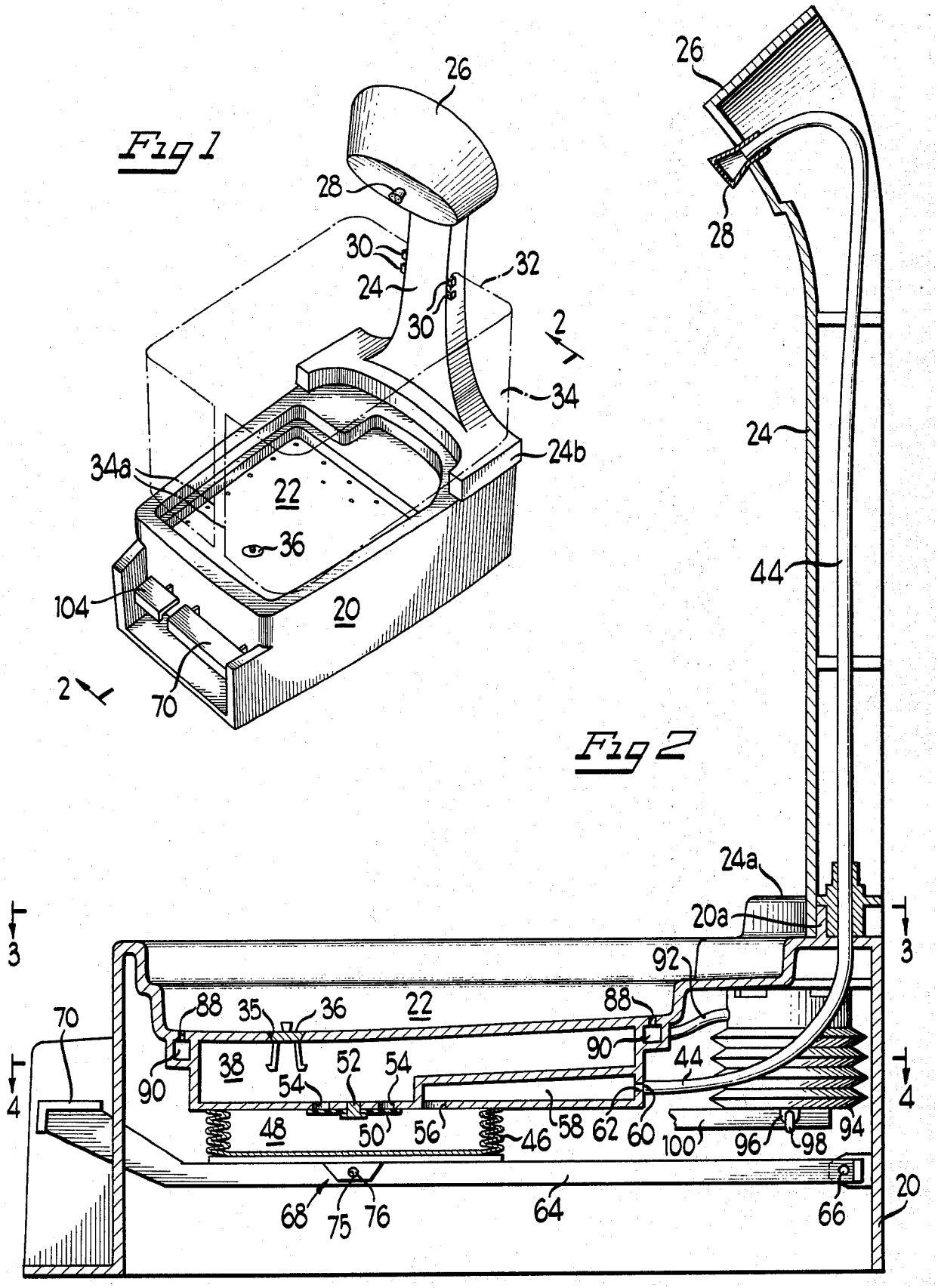
FIG. 1 is a perspective view of an embodiment of the toy shower and bubble bath device in accordance with the present invention.
FIG. 2 is an enlarged vertical sectional view taken generally along the line 2—2 of FIG. 1.

Referring first to FIGS. 1 and 2, the doll shower and bubble bath device, as illustrated, includes a base 20 having a tub 22 for receiving water for doll bathing purposes. A support post 24 upstands from base 20 and supports a shower head 26 which includes a shower nozzle 28. Support post 24 also includes two pairs of laterally outstanding lugs 30 (FIGS. 1 and 7) each having a vertical bore 30a for receiving downwardly turned ends of a wire which is provided in the form of a toy shower curtain rod 32. Shower curtain rod 32 supports a flexible shower curtain 34 which is mounted for slideable pleating movement on rod 32 in a normal shower curtain mounting fashion. The curtain 34 is preferably in two pieces having vertically extending terminal edges at 34a for separating the curtain at a seam to place a doll in tub 22. Alternatively, the curtain 34 can be made of a generally stiff or rigid clear plastic material and any doll to be placed in the tub 22 can be inserted over the top of curtain 34.

Tub 22 also has a drain port 35 and removable plug 36 in the bottom thereof for draining liquid from tub 22 into a liquid reservoir 38 therebelow.

Figure 3:
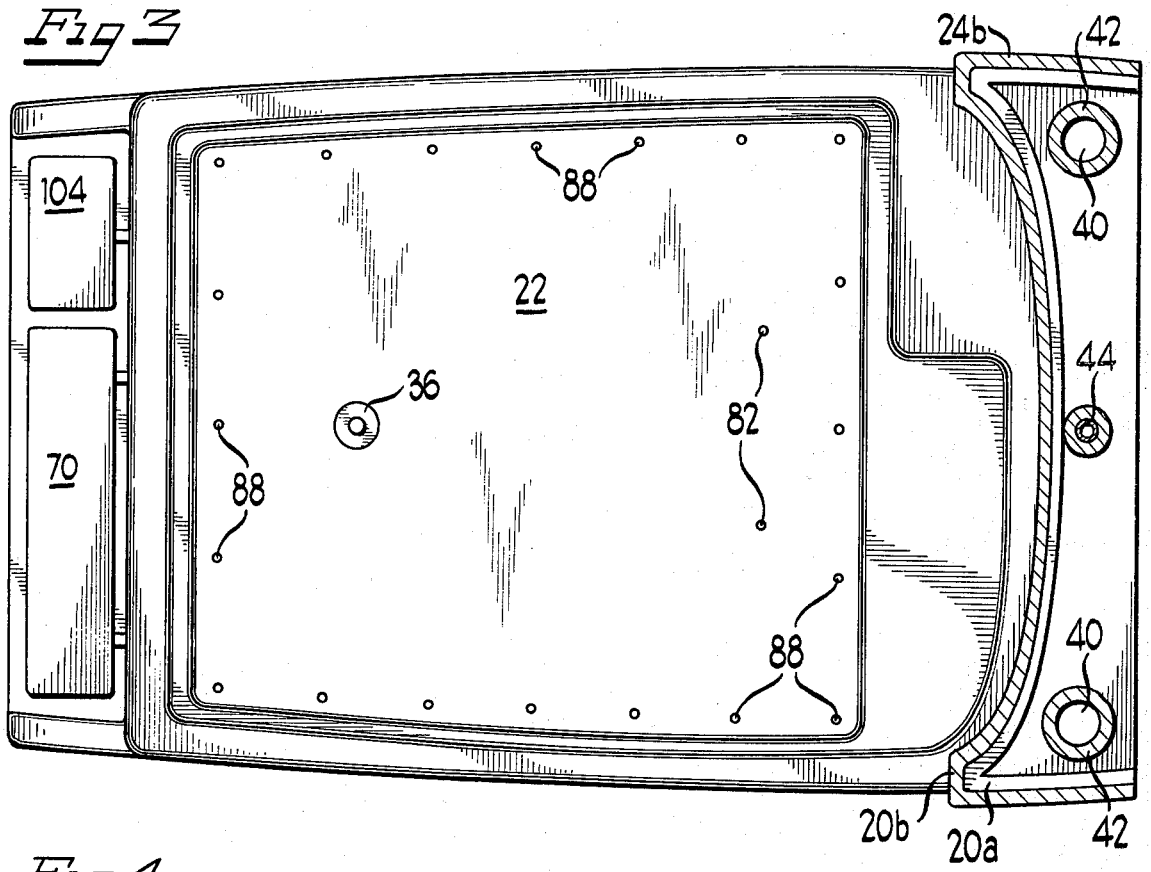
FIG. 3 is a sectional view taken generally along line 3—3 of FIG. 2.

The support post 24 is removable from base 20 for purposes of compactness in storage. Accordingly, support post 24 is provided with a widened base portion 24a having a depending peripheral flange 24*b* (FIGS. 1, 3 and 8). Base 20 has an upstanding flange 20*a* configurated for telescopic reception of flange 24*b* thereover. Also, on base 20, upstanding pins 40 (FIGS. 3 and 8) are provided, one each laterally of the center line of base 20 and the center line of post 24. The laterally extending bottom portion 24*a* of post 24 has a pair of depending inverted cup-like cylindrical pin receivers 42 receiving the pins 40 on base 20. It is apparent that upward movement of post 24 will disengage flange 24*b* from flange 20*a* and receiver 42 from pin 40. The curtain rod 32 can be removed from the lugs 30 and the device can be stored in a compact condition. The curtain rod 32 and post 24 can be reassembled readily with the base 20 whenever it is desired to use the device.

As best seen in FIG. 2, the nozzle 28 is supplied with liquid in the form of water or a water-soap mixture through a flexible plastic conduit or tube 44 which extends upwardly within post 24. Nozzle 28 directs the liquid as a spray toward the tub 22 in a shower fashion. The water is driven through conduit 44 by a pump in the form of a bellows 46 which includes an interior pumping cavity 48. The bellows 46 depends from and is sealed to the bottom wall of chamber 38 so that the bottom wall of chamber 38 forms the top wall of bellows 46.

Also, on the bottom wall of chamber 38, a rubber or other flexible disc 50 is secured to the wall by a rivet 52 through the central portion of the disc 50. The bottom wall of chamber 38 also is provided with a plurality of ports 54 (FIGS. 2 and 4), e.g., four in the illustrated embodiment so that as bellows 46 is expanded disc 50 withdraws from ports 54 and liquid in chamber 38 is drained or sucked through ports 54 into chamber 48. As bellows 46 again is compressed, the disc 50 is pushed upward to again cover and seal ports 54 and the liquid in chamber 48 is forced through a port 56 and chamber 58 and into tube 44 for discharge through nozzle 28. Tube 44 is connected with chamber 58 by a disconnect or slipfit connection, such as is shown at 60 (FIG. 2), so that when post 24 is disassembled from base 20, tube 44 can be disconnected and removed along with post 24. Also, the port 62, communicating chamber 58 with tube 44, is restricted to inhibit drawing of air through tube 44 by bellows 46 during expansion of bellows 46 so that chamber 48 receives mostly, or only, water.

For operating the bellows 46, a bifurcated lever 64 is pivotally connected at 66 to the interior of the rear wall of base 20 and also is pivotally connected at 68 to the bottom wall of bellows 46. Lever 64 extends through slots **20*b* in the front wall of base 20 and has a button or key end 70** accessible for manipulation by a child.

Turning now to FIG. 5, the pivotal connection at 68 includes a lug 72 depending from the bottom wall of bellows 46. Lug 72 has a bore 74 in axial alignment with bores 75 through the two arms of the bifurcated lever 64. Passing through the series of bores 74 and 75 is an elongated rod 76 (see also FIG. 4) which depends from and is biased upwardly by a pair of coil tension springs 78 which are, in turn, secured at their upper ends and thereby grounded by lugs 80. The rod 76 forms the pivotal connection 68 between lever 64 and the bottom wall of bellows 46.

It will be seen that each time handle 70 is depressed, lever 64 will pivot about its pivotal mounting at 66 and will depress the bottom of bellows 46 to expand bellows 46 against the urging of the tension springs 78, thereby drawing liquid down through ports 54. When handle 70 is released springs 78 will override the weight of lever 64 and return bellows 46 to its compressed position thereby driving liquid from cavity 48 through port 56 and thence through nozzle 28.

A pair of vent or relief holes 82 (FIG. 3) are provided through the bottom wall of tub 22 so that when drain plug 36 is pulled to open the drain 35 (FIG. 2) and supply cavity 38 with water for delivery to bellows cavity 48, air is readily displaced from cavity 38.

Figure 4:
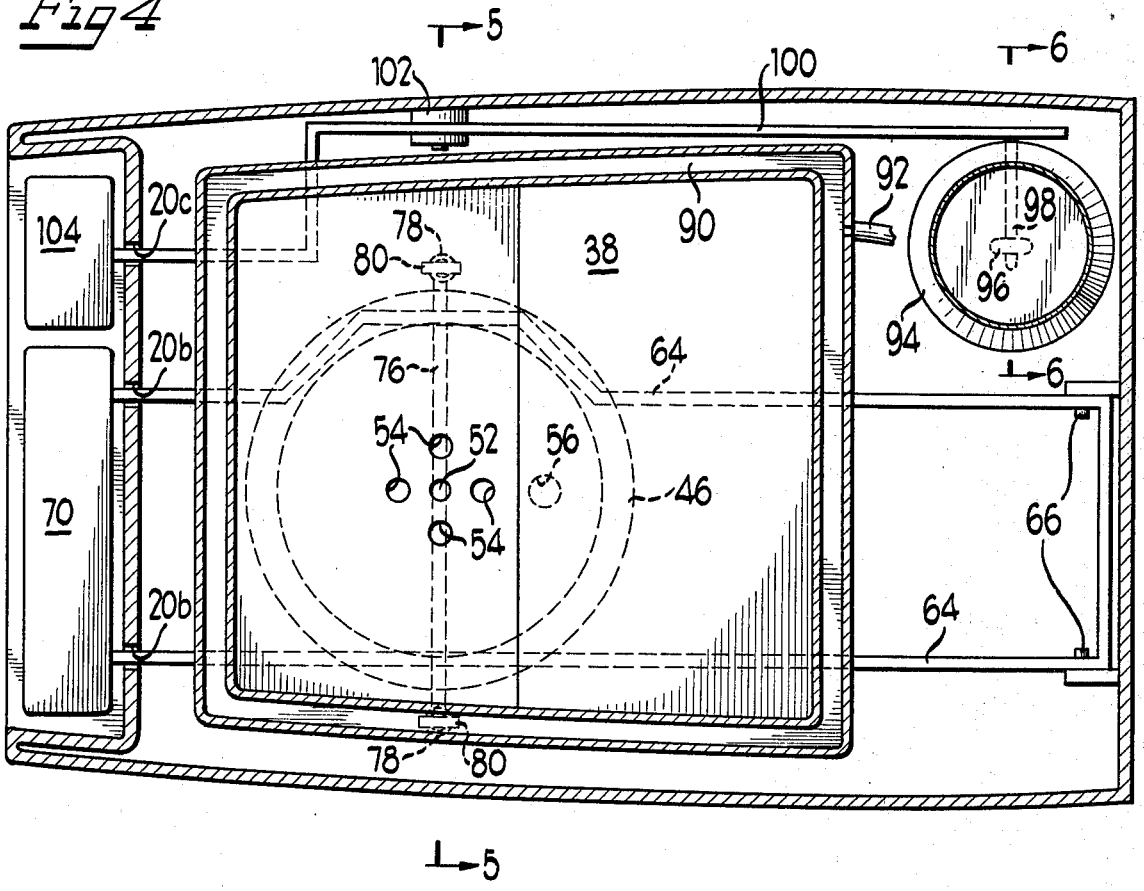
FIG. 4 is a sectional view taken generally along line 4—4 of FIG. 2.

The bottom wall of tub 22 also is provided with a series of peripheral air introduction ports 88 (FIGS. 2 and 3). The purpose of ports 88 is to introduce bubbling air into the tub 22 when the tub contains liquid to produce a bubbling effect. Accordingly, on the bottom of the bottom wall of tub 22 a peripheral manifold 90 is provided (FIGS. 2, 4 and 5) which communicates with and supplies air to each of the ports 88. Air is supplied to manifold 90 through a tube 92 connected to a pump in the form of a bellows 94 (FIGS. 2, 4 and 6). The bottom wall of bellows 94 has a lug 96 with a bore 97 receiving a laterally extending hook arm 98 secured at its other end to a lever 100 which in turn is pivotally mounted at 102 and extends through a slot 20c in the forward wall of base 20 and terminates as a button or key 104 accessible to the child user of the device. Each time button 104 is depressed arm lever 100 pivots about its pivot point at 12 to raise arm 98 and compress the bellows 94 forcing air through tube 92 into conduit 90 and thence through ports 88. When key 104 is released, the weight of arm 100 re-extends bellows 94 and air is sucked into bellows 94 through a check valve 106 for use during the next depression of key 104.

The check valve 106, best seen in FIG. 6, is of the same type as is used in combination with bellows 46 and accordingly includes a flexible, usually rubber, flat disc 108 secured centrally by a rivet 110, or the like, and blocking emission of air from bellows 94 though ports 112 during compression of bellows 94 but on the expansion stroke of bellows 94 the disc 108 is pulled downward to permit entry of air though the ports 112. The ports 88 are sufficiently small compared to ports 112 to inhibit, by surface tension or otherwise, sucking of liquid from tub 22 into manifold 90 during expansion of bellows 94. It is evident that the shower and bubble bath accessory for use with dolls or other figurines as described provides amusement or entertainment for children.

The foregoing detailed description has been given for clearness of understanding only and no unnecessary limitations should be understood therefrom as some modifications will be obvious to those skilled in the art.

We claim:

1. An amusement device in the form of an accessory for use in combination with a doll or other figurine, said device comprising: a base having a depression defining a tub for containing a body of liquid, such as water, for washing the doll during play; a shower head having a nozzle supported above said tub with the nozzle directed downwardly for delivering liquid into said tub for showering a doll positioned in the tub; pump means for pumping liquid through said nozzle; first selectively operable means for actuating said pump means; aeration means for delivering air in the form of bubbles into a body of liquid in said tub for simulating a bubble bath effect; and second selectively operable means for actuating said aeration means.

2. The device of claim 1 wherein said pump means receives liquid from said tub for recirculating the liquid through the nozzle.

3. The device of claim 2 wherein said pump means is a bellows having a check valve at its intake for receiving liquid from the tub for recirculation.

4. The device of claim 3 wherein the first selectively operable means comprises a manually operable lever for extending the bellows and including tension spring means normally maintaining the bellows in compressed condition and for returning the bellows to compressed condition after expansion and release of the lever.

5. The device of claim 3 wherein said check valve comprises a flexible disc secured to the bellows top wall at a central part of the disc leaving the peripheral part of the disc unsecured, and a plurality of intake ports though the bellows top wall located within the peripheral portion of the disc so that on the intake stroke the disc is pulled away from the ports permitting entry of liquid into the bellows and on the return stroke of the bellows the disc is forced against the ports to prevent discharge of liquid therethrough, and including a separate outlet port and conduit means for delivery of liquid from the belllows to the nozzle.

6. The device of claim 1 wherein said tub includes a drain hole and a removable drain plug, a drainage receiving compartment below the tub and integral with a tub bottom wall, the tub bottom wall forming the top wall of said drainage receiving compartment, and said pump means delivers liquid from said drainage receiving compartment to said nozzle.

7. The device of claim 1 wherein said nozzle is supported by an upstanding post and including means for removably mounting said post on the tub base.

8. The device of claim 7 including a shower curtain supported by a rod and means for removably mounting said rod on said post.

9. The device of claim 1 wherein said aeration means comprises an air pump.

10. The device of claim 9 wherein said air pump comprises a bellows having a check valve at its intake.

11. The device of claim 10 including manually operable lever means for operating said bellows.

12. The device of claim 9 wherein said aeration means includes a manifold for receiving air from said air pump and a plurality of air ports in the bottom wall of said tub and in communication with the manifold for delivering air through the tub bottom wall and forming bubbles in a body of liquid within the tub.

* * * * *